US009083067B2

(12) United States Patent
Neumaier et al.

(10) Patent No.: US 9,083,067 B2
(45) Date of Patent: Jul. 14, 2015

(54) COAXIAL CONDUCTOR STRUCTURE

(75) Inventors: Christoph Neumaier, Baiern (DE); Martin Lorenz, Mittenwald (DE); Natalie Spaeth, Rosenheim (DE); Kai Numssen, Höhenkirchen-Siegertsbrunn (DE); Josef Kreuzmair, Bruckmühl (DE)

(73) Assignee: Spinner GmbH, Westerham (DE)

( * ) Notice: Subject to any disclaimer, the term of this patent is extended or adjusted under 35 U.S.C. 154(b) by 342 days.

(21) Appl. No.: 13/635,114

(22) PCT Filed: Mar. 29, 2011

(86) PCT No.: PCT/EP2011/001583

§ 371 (c)(1),
(2), (4) Date: Sep. 14, 2012

(87) PCT Pub. No.: WO2011/124350

PCT Pub. Date: Oct. 13, 2011

(65) Prior Publication Data

US 2013/0015927 A1 Jan. 17, 2013

(30) Foreign Application Priority Data

Mar. 30, 2010 (DE) ..... 10 2010 013 384

(51) Int. Cl.
*H01P 3/06* (2006.01)
*H01P 1/16* (2006.01)

(52) U.S. Cl.
CPC ... *H01P 1/16* (2013.01); *H01P 3/06* (2013.01)

(58) Field of Classification Search
CPC ..... H01P 3/06; H01P 1/16
USPC ..... 333/236, 242, 243, 245, 248, 222, 206
See application file for complete search history.

(56) References Cited

U.S. PATENT DOCUMENTS

| | | | | |
|---|---|---|---|---|
| 3,659,232 | A | 4/1972 | Foley | |
| 4,151,494 | A * | 4/1979 | Nishikawa et al. | 333/204 |
| 4,223,287 | A * | 9/1980 | Nishikawa et al. | 333/206 |
| 4,398,164 | A * | 8/1983 | Nishikawa et al. | 333/222 |
| 2004/0140862 | A1 | 7/2004 | Brown et al. | |
| 2008/0150649 | A1 | 6/2008 | Fischer et al. | |
| 2012/0193123 | A1 * | 8/2012 | Futabatake et al. | 174/126.1 |

FOREIGN PATENT DOCUMENTS

| | | |
|---|---|---|
| DE | 27 05 245 | 8/1977 |
| GB | 1 568 255 | 8/1977 |

OTHER PUBLICATIONS

Douglas E. Mode: "Spurious Modes in Coaxial Transmission Line Filters", Proceedings of the Institute of Radio Engineers, Bd. 38, Feb. 1, 1950, pp. 176-180, XP55003221.

* cited by examiner

*Primary Examiner* — Dean Takaoka
*Assistant Examiner* — Alan Wong
(74) *Attorney, Agent, or Firm* — Fitch Even Tabin & Flannery

(57) ABSTRACT

A coaxial conductor structure for the interference-free transmission of a propagable TEM mode of an HF signal wave within at least one band of n frequency bands forming within a dispersion relation.

30 Claims, 3 Drawing Sheets

COAXIAL CONDUCTOR STRUCTURE

CROSS REFERENCE TO RELATED APPLICATIONS

Reference is made to patent application No. DE 10 2010013 384.1 filed Mar. 30, 2012 and PCT/EP2011/001583 filed Mar. 29, 2011, which applications are incorporated herein by reference in their entirety.

BACKGROUND OF THE INVENTION

The invention relates to a coaxial conductor structure for interference-free transmission of a TEM fundamental mode of an HF signal wave.

DESCRIPTION OF THE PRIOR ART

The transmission quality of coaxial conductors for the TEM fundamental mode of HF signal waves diminishes with rising signal frequencies, especially since, at higher frequencies, mode conversion processes along the coaxial line lead to undesired, propagable modes of a higher order, e.g., $TE_{11}$, $TE_{21}$ modes, etc., which become superimposed with the TEM fundamental mode.

For example, an article by Douglas E. Mode entitled "Spurious Modes in Coaxial Transmission Line Filters", Proceedings of the I.R.E., Vol. 38, 1950, pp. 176-180, DOI 10.11090/JRPROC.1950.230399, examines the lower frequency limit for an interference-generating, lowest TE mode along a coaxial line, along which so-called shunt inductors are secured in the form of internal and external conductors of the coaxial line. In order to analytically determine the lower frequency limit, simplified assumptions are made, or a modified rectangular waveguide representing the coaxial line is taken as the basis. No dispersion relations are calculated for the TEM and $TE_{11}$ mode.

In particular with respect to future expansions or modifications of existing transmission ranges for HF signals stipulated in the frequency utilization plan for the Federal Republic of Germany to higher frequencies, measures must be found to enable as interference-free, high-frequency a signal transmission of the TEM fundamental mode of HF signals as possible via coaxial lines with the largest possible diameter.

The coaxial conductor structure according to the invention proceeds from the transmission behavior of coaxial lines changing significantly for HF signal waves if electrically conductive connecting structures are introduced between the external and internal conductor at respective periodically equidistant intervals along the coaxial line. As revealed by an examination of the propagation behavior of the TEM fundamental mode along a conventional coaxial line, that is, the external and internal conductors are electrically insulated by the interspersed dielectric, within the framework of a dispersion diagram, a linear correlation exists between the frequency respectively the circuit frequency $\omega$ and the propagation constant $\beta$ of the HF signal wave with the form $e^{j(\omega c-\beta c)}$, i.e., $\omega=c\beta$. This linear correlation is manifested as a so-called light speed line in a dispersion diagram $\omega(\beta)$. Starting at a lower frequency limit, the so-called cut-off frequency ($f_{co}$) for the $TE_{11}$ mode, rising frequencies are accompanied by the formation along the conventional coaxial line of undesired propagation modes of a higher order, $TE_{11}$, $TE_{21}$, $TE_{31}$, $TE_{41}$, $TM_{01}$, $TM_{11}$, etc., so that the TEM base mode is always superimposed by modes with a higher order of excitation at frequencies exceeding $f_{co}$.

By contrast, providing electrically conductive structures between the external and internal conductor of the coaxial line in the manner indicated above leads to the formation of frequency bands in which the TEM fundamental mode is able to propagate, along with band gaps lying between the frequency bands, in which the TEM fundamental mode is evanescent, that is, are unable to propagate. Even though this result would at first glance appear disadvantageous, especially since the frequency-specific transmission range for the TEM fundamental mode is curtailed by comparison to a conventional coaxial conductor, this disadvantage can be used in accordance with the invention.

In addition, it has been found that adding the electrically conductive connecting structures between the external and internal conductor of the coaxial line causes a frequency windowing of the TEM fundamental mode into specific, propagable frequency bands as described above, even at the excitation modes of a higher order. That is, even the higher excitation modes, $TE_{11}$, $TE_{21}$, etc. are accompanied by the formation of frequency ranges in which the modes are propagable, and other frequency ranges in which they are evanescent.

The concept underlying the invention is based on the consideration that, by selecting the right structural design parameters for setting up a coaxial line with electrically conductive connecting structures between the external and internal conductor, the frequency-dependent positions of the frequency bands denoted above can be specifically and controllably influenced in such a way that at least one frequency band in which the TEM fundamental mode is propagable can be made to cover or overlap a frequency band or range in which all excitation modes of a higher order are evanescent.

In order to further explain the terminology, it is assumed that a number "n" of specific frequency bands in which the TEM fundamental mode is propagable forms in the coaxial conductor structure according to the invention. The counting parameter "n" here starts at one, and represents a natural, positive number. In like manner, "m" specific frequency bands form, in which the $TE_{11}$ mode is propagable, wherein "m" also represents a positive, natural number as the counting parameter. While there is no further discussion relating to the appearance of higher order excitation modes, especially since the latter arise at frequencies whose technical applicability is regarded as less relevant, at least at present, these excitation modes can also be taken into account in an equivalent application of the invention.

A coaxial conductor structure of the invention for providing the interference-free transmission of a mono-mode TEM fundamental mode of an HF signal wave in at least one band of n frequency bands that form within the framework of a dispersion relation has the following components:

a) An internal conductor with a preferably circular cross section and an internal conductor diameter $D_i$, although cross sectional forms that approximate a circular shape are also conceivable, that is, with an n-gonal circumferential contour, b) An external conductor that radially envelops the internal conductor with an external conductor inner diameter Da, preferably in a radially equidistant manner, although cross sectional forms that approximate a circular shape are also conceivable, that is, with an n-gonal circumferential contour, and c) An axially extending, common conductor section of the internal and external conductor, along which, in equidistant intervals p and s rod-shaped structures with a rod diameter $D_S$ that electrically connect the internal conductor with the external conductor are provided. While rods with a circular cross section are preferably suitable, the rod cross sections can also be n-gonal or the like. In order to allow the TEM fundamental mode to propagate along the coaxial conductor structure unimpeded by higher excitation modes, which arise at least in the form of a $TE_{11}$ mode within m frequency bands, the above parameters $D_i$, $D_a$, $D_S$, p, s must be selected in such a way that the following two conditions are satisfied:

i) A lower cut-off frequency $f_u$(TEM) of the TEM mode propagating within an n≥2-nd band is equal to an upper cut-off frequency $f_o(TE_{11})$ of the forming $TE_{11}$ mode in the m-th band; and ii) An upper cut-off frequency $f_o$(TEM) of the TEM mode propagating within an n 2-nd band is equal to a lower cut-off frequency $f_u(TE_{11})$ of the $TE_{11}$ mode forming within the (m+1)-th band.

In terms of the invention, the above required mathematical relations must be regarded as somewhat variable, that is, a technically acceptable mono-mode propagation of the TEM mode can also be used if the following applies:

$$|f_u(TEM, n) - f_o(TE11, m| < \frac{1}{3}(f_o(TEM, n) - f_u(TEM, n))| \quad \text{i)}$$

*as* well as $$|f_o(TEM, n) - f_u(TE11, m+1)| < \frac{1}{3}(f_o(TEM, n) - f_u(TEM, n)) \quad \text{ii)}$$

As has been demonstrated, a technical utilization of the TEM mode without any notable loss in quality is possible in an area where the propagable TEM mode slightly overlaps the $TE_{11}$ mode. This tolerance range Δf measures at most ⅓ of the n-th TEM bandwidth.

It has further been shown that the measures according to the invention for creating a frequency window that is able to propagate without interference for the EM mode along a coaxial conductor structure can also be successfully applied for a coaxial conductor structure in which the internal conductor and/or external conductor cross section of the coaxial line deviates from the circular shape, but exhibits the same wave resistance as the round coaxial line. For example, the external and internal conductor cross section can here be n-gonal. However, the other considerations relate to respectively circular cross sectional shapes.

As further statements will demonstrate, suitably selecting the structural design parameters $D_i$, $D_a$, $D_S$, p, s makes it possible to establish coaxial conductor structures that enable a completely interference-free propagation of the TEM fundamental mode in frequency ranges exceeding the cut-off frequency $f_{co}$ of the $TE_{11}$ mode without any higher order excitation modes, and do so at frequencies so high that higher order excitation modes would be unavoidable in conventional coaxial conductors.

In like manner, giving the coaxial conductor structure according to the invention a suitable structural design makes it possible to shift the cut-off frequency $f_{co}$ to higher frequency values, and in so doing expand the first frequency band in which the TEM fundamental mode is mono-modally propagable toward higher frequencies.

Such a coaxial conductor structure according to the invention is characterized by the structural design parameters $D_i$, $D_a$, $D_S$, p, s discussed above. These parameters must be selected in such a way that an upper cut-off frequency $f_o$(TEM) of the TEM mode propagating within the first, that is, n=1, band is less than or equal to the lower cut-off frequency $f_u(TE_{11})$ of the forming $TE_{11}$ mode in the first band, that is, m=1, wherein the following applies:

$$f_o(TEM) = \frac{c}{2p} \text{ and}$$

$$f_u(TE_{11}) = \sqrt{\frac{6a}{3+a} f_0^2 + f_{co}^2}, \text{ so that } \frac{c}{2p} \le \sqrt{\frac{6a}{3+a} f_0^2 + f_{co}^2}.$$

The following applies here:

$$f_0 = \frac{c}{2\pi p}, f_{co} \cong \frac{c}{\pi} \frac{2}{D_a + D_i} \text{ and}$$

$$a = \frac{sZ_{TEM}\, p}{2cL_{rod}} \; und \; Z_{TEM} = \frac{1}{2\pi}\sqrt{\frac{\mu}{\varepsilon}} \ln\frac{D_a}{D_i}.$$

It will be assumed for the above correlations that c represents light speed in the dielectric, normally air. It should be noted for this coaxial conductor structure according to the invention that the lower frequency limit of the $TE_{11}$ in the first band, and hence the mono-mode TEM operation, increases to $$f_u(TE_{11}) = \sqrt{\frac{6a}{3+a} f_0^2 + f_{co}^2}$$

by comparison to $f_u(TE_{11})=f_{co}$ of a conventional coaxial line.

In addition to the design criteria for coaxial conductor structures outlined above, which quite essentially provide for using the electrically conductive structures that connect the external and internal conductors, and at least in certain frequency bands enable interference-free transmission properties exclusively for the TEM fundamental mode, precisely the electrically conductive structures help to specifically cool the internal conductor, which is subjected to considerable warming in particular during the transmission of powerful HF signals. Since the electrically conductive connecting structures preferably are of rod-shaped structures made out of a metal material, which is preferably the same material the internal and/or external conductor, are made of, they exhibit a high thermal conductivity. As a consequence, electrically conductive materials are suitable for these structures, which have an especially high thermal conductivity.

BRIEF DESCRIPTION OF THE DRAWINGS

The invention will be described by example below based on exemplary embodiments, making reference to the drawings, and without in any way limiting the general inventive idea.

DETAILED DESCRIPTION OF THE INVENTION

Figure 1:
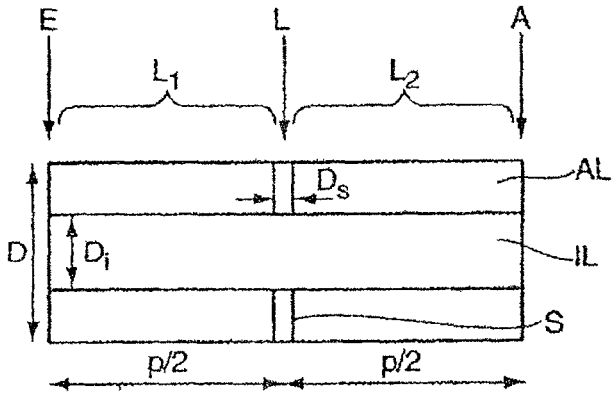
FIG. 1 illustrates a section of a coaxial conductor structure designed according to the invention.

FIG. 1 illustrates a section of a coaxial conductor structure according to the invention. The section represents a kind of elementary cell for building up a coaxial line, which in the end is characterized by a periodic repeating of the illustrated section. The transparently depicted external conductor AL has an external conductor inner diameter Da, and incorporates an internal conductor IL having a length p, a circular conductor cross section and an internal conductor diameter Di. Provided centrally to the longitudinal extension p of the internal conductor IL are s=2 rod-shaped structures S, which establish an electrically conductive contact or electrically conductive connection with the external conductor AL. The rod-shaped structures S are made out of an electrically and thermally readily conductive material, preferably metal, especially preferably out of the same material used to fabricate the internal or external conductor. The structures S can exhibit a circular or n-gonal cross section. It will be assumed for the continued mathematical analysis that the structures exhibit diameter $D_S$.

It is possible to provide a single, that is, s=1, rod-shaped structure S per elementary cell. Further deliberations and corresponding computations demonstrate that especially favorable transmission properties for the coaxial line are achieved when s=2, 3 or 4. In the case of s=1 or s=2, it makes sense to arrange the rod-shaped structures situated in respectively equidistant intervals p along the coaxial line relative to the circumferential direction of the internal and external conductor in such a way that the rod-shaped structures are each congruently located one behind the other in an axial projection to the axially extending, common conductor section, or each offset at an identical angular misalignment $\Delta\alpha$ oriented in the circumferential direction of the internal and external conductor IL, AI. For example, in the case of s=1 or 2, it is advantageous to arrange two axially sequential rod-shaped structures twisted by $\Delta\alpha=90°$ around the coaxial conductor longitudinal axis, so as to minimize potential magnetic couplings between the rods.

The elementary cell depicted on FIG. 1 for building up a coaxial line according to the invention will be used below to describe the electromagnetic design of such a line, so as to be able to conform desired dispersion relations of the technically used TEM fundamental mode and interfering TE11 mode. The goal is to design coaxial conductor structures with relatively large diameters Da, which have only a single propagable mode, specifically the TEM fundamental mode, in a desired frequency range bounded by a lower $f_u$ and upper $f_o$ cut-off frequency. All other modes in this frequency range are to be evanescent.

The advantage of the symmetrical elementary cell shown on FIG. 1 is that its input impedances at input E and output A are identical. The cell has of two lines L1, L2 with impedance $$Z = Z_{TEM} = \frac{1}{2\pi}\sqrt{\frac{\mu}{\varepsilon}}\ln\frac{D_a}{D_i},$$

propagation constant $$\gamma = j\frac{\omega}{c}$$

and length l=p/2 and an interspersed shut admittance Y=1/jωL. The rods can be described by an approximation using an inductance L expressed as:

$$L = \frac{L_{rod}}{s},\ L_{rod} \approx \frac{(D_a - D_i)}{2}\frac{\mu}{4\pi}\ln\frac{D_a}{D_s},$$

wherein s is the number of radial rods.

The individual sections of the elementary cell, L1, L, and L2 can be described by ABCD matrices, which can be simply cascaded through matrix multiplication. The ABCD matrix for line L1, L2 is given by $$ABCD_{TL} = \begin{pmatrix} \cosh(\gamma l) & Z\sinh(\gamma l) \\ \frac{1}{Z} & \cosh(\gamma l) \end{pmatrix}, \tag{1}$$

and the shunt inductance L by $$ABCD_L = \begin{pmatrix} 1 & 0 \\ \frac{1}{j\omega L} & 1 \end{pmatrix}. \tag{2}$$

For the entire elementary cell, this yields $$ABCD_{cell} = ABCD_{TL}ABCD_LABCD_{TL} \tag{3}$$

The Bloch analysis can now be performed, during which periodic boundary conditions are used, that is, voltage+current at the output is equal to voltage+current at the input multiplied by a phase factor exp(jϕ). This yields $$\begin{pmatrix} U_1 \\ L_1 \end{pmatrix} = ABCD_{cell}\begin{pmatrix} U_2 \\ I_2 \end{pmatrix} = e^{j\varphi}\begin{pmatrix} U_2 \\ I_2 \end{pmatrix} \tag{4}$$

and reveals an eigenvalue problem with two eigenvalues $e^{j\phi_k}$. It here turns out that $\phi_1=-\phi_2$, applies, that is, a respective forward and reflected wave is involved. The following determinants must disappear to calculate the eigenvalue:

$$\begin{vmatrix} A - e^{j\varphi} & B \\ C & D - e^{j\varphi} \end{vmatrix} = 0 \tag{5}$$

A lengthier computation yields $$\cos\frac{p\omega}{c} + \frac{Z}{2\omega L}\sin\frac{p\omega}{c} = \cos\varphi \tag{6}$$

Figure 2:
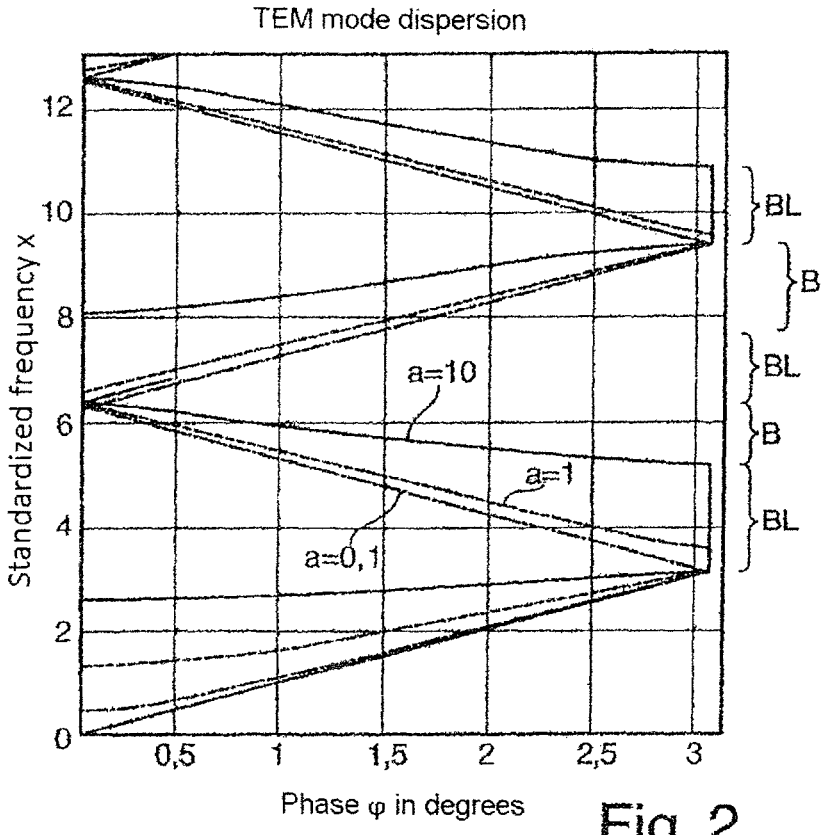
FIG. 2 is a TEM dispersion diagram.

It here makes sense to normalize the frequency to $$x = \frac{p}{c}\omega = \frac{2\pi p}{c}f,$$

yielding $$\cos x + \frac{a}{x}\sin x = \cos\varphi \tag{7}$$

wherein $$a = \frac{Zp}{2cL}$$

represents a dimensionless parameter for the so-called perturbation by L. This equation (7) can be solved for ϕ. Finally, plotting x $$\varphi(x) = \arccos\left(\cos x + \frac{a}{x}\sin x\right)$$

results in the TEM dispersion diagram depicted on FIG. 2, shown here for different values of a.

As clearly evident, the periodic shunt inductance generates bands B and band gaps BL. A TEM wave is propagable in the bands B, while the wave is evanescent and attenuated at frequencies within a band gap.

Obtained for a=0 (that is, L becomes infinite, transverse rods disappear, dashed curve) is the typical light speed line $$f = \frac{c}{2\pi p}\varphi$$

of the interference-free coaxial line, which is folded into the first Brillouin zone along a zigzag pattern. The other extreme case is at a=∞, L=0: Obtained here are uncoupled line resonators having length p and resonance frequencies x=nπ, that is, λ/2 resonators. The bands here shrink together into dot frequencies.

Subjecting the left side of the equation (7) to series expansion at points x=nπ up to the $2^{nd}$ order and having it be equal to (−1)" makes it possible to calculate the cut-off frequencies ($f_u$, $f_o$) of the individual bands by approximation for small perturbations a<<3n, yielding as follows for the first band with the lowest frequency:

$$x_{1,o} = \pi \tag{8}$$

$$x_{1,u} \cong \sqrt{\frac{6a}{3+a}} \approx \sqrt{2a}$$

And for the n-th band with n>1:

$$x_{n,o} = n\pi \tag{9}$$

$$x_{n,u} \cong (n-1)\pi + \frac{2a/(n-1)/\pi}{1 + 2a/(n-1)^2/\pi^2} \approx (n-1)\pi + \frac{2a}{(n-1)\pi}$$

By contrast, the following is obtained at very large perturbations a>>3n for the n-th band (n>=1):

$$x_{n,o} = n\pi \tag{10}$$

$$x_{n,u} \cong n\pi - \frac{n\pi a}{n^2\pi^2 + 2a}\left(\sqrt{1 + \frac{8}{a} + \frac{4n^2\pi^2}{a^2}} - 1\right) \approx n\pi - \frac{2n\pi}{a}$$

As a result, TEM dispersion has been completely characterized, and can be defined as a function of the geometry. A band will typically be used for transmission in such a way that the actually usable frequency range distinctly exceeds the one required. This makes it possible to compensate for production tolerances, minimize high insertion losses owing to the disappearing group velocity (slope=0) at the band limits, and minimize high reflections owing to the increasing deviation of the frequency-dependent Block impedance from the target impedance at the band limits.

The so-called Bloch impedance $Z_B$ is the effective impedance of the periodic line and is the input impedance of an infinitely long periodic structure. In order to connect the periodic structure to a conventional coaxial line with impedance $Z_W$ in as reflection-free manner as possible, $Z_B$ should come as close as possible to $Z_W$.

The Bloch impedance can be calculated from the voltage and current of an elementary cell at periodic boundary conditions, that is, from the two components of the eigenvector of the eigenvalue problem (4):

$$\begin{aligned} Z_B(\omega) &= \frac{U_1}{I_1} \\ &= \frac{U_2}{I_2} \\ &= -\frac{B}{A - e^{j\varphi}} \\ &= \frac{B}{\sqrt{A^2 - 1}} \\ &= Z_{TEM}\frac{\sin\frac{p\omega}{c} + \frac{Z_{TEM}}{2\omega L_{TEM}}\left(1 - \cos\frac{p\omega}{c}\right)}{\sqrt{1 - \left(\cos\frac{p\omega}{c} + \frac{Z_{TEM}}{2\omega L_{TEM}}\sin\frac{p\omega}{c}\right)^2}} \end{aligned} \tag{11}$$

Figure 3:
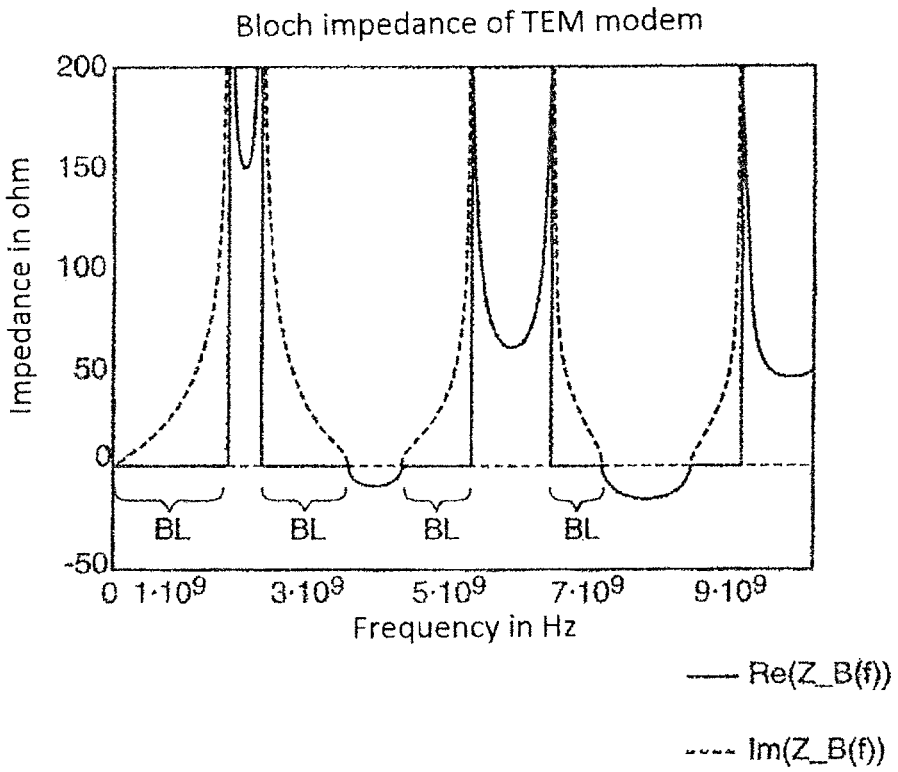
FIG. 3 is a diagram of the Bloch impedance for the TEM mode.

The diagram illustrated on FIG. 3 depicts the strong frequency dependence of the Block impedance $Z_B$, which can deviate to an extreme from the impedance of the interference-free coaxial line $Z_{TEM}$. This example used a=7.8, p=72 mm and $Z_{TEM}$=28Ω.

$Z_B$ is purely imaginary in the band gaps BL, as it should be for a reactive load that absorbs no active power. In contrast, $Z_B$ is real in the transmission bands B and moves ever closer to the value for the interference-free line $Z_{TEM}$ in the higher bands, where perturbation arising from the inductances has a weaker effect. Clearly evident as well is how the Bloch impedance becomes negative in the even-numbered bands, which has to do with the negative group velocity (that is, slope dω/dβ<0), so that the current changes its sign.

A periodic structure will preferably be conceived in such a way that the reflection $r=Z_B-Z_W/Z_B+Z_W$ remains less in terms of amount than a given $r_{max}$ in the transmission range B, for example $|r|<r_{max}$=0, 1. This represents a secondary condition for determining or optimizing the geometric parameters.

The $TE_{11}$ mode can be modeled similarly to the TEM fundamental mode described above, especially since the structural design of the elementary cell and the equivalent circuit diagram associated therewith is the same as in the case of the TEM fundamental mode, only the propagation constant and impedance become highly dependent on frequency with respect to the waveguides:

$$Z(f) = \frac{\ln\frac{D_a}{D_i}}{\pi}\sqrt{\frac{\mu}{\varepsilon}}\frac{1}{\sqrt{1 - f_{co}^2/f^2}}, \tag{12}$$

$$\gamma(f) = j\frac{2\pi f}{c}\sqrt{1 - f_{co}^2/f^2},$$

$$f_{co} \cong \frac{c}{\pi}\frac{2}{D_a + D_i}.$$

with the approximated $TE_{11}$ cut-off frequency

If the same calculation as in the TEM case is performed similarly to (6), the following equation is obtained for the $TE_{11}$ mode:

$$\cos\frac{p\omega}{c}\sqrt{1 - f_{co}^2/f^2} + \frac{2Z_{TEM}\Big/\sqrt{1 - f_{co}^2/f^2}}{2\omega L_{TE}}\sin\frac{p\omega}{c}\sqrt{1 - f_{co}^2/f^2} = \cos\varphi \tag{13}$$

Since the same root appears in the impedance and the propagation constant, a transformation to a normalized frequency x can be performed as in the TEM case, and the same equation is in fact obtained once again $$\cos x_{TE} + \frac{a_{TE}}{x_{TE}}\sin x_{TE} = \cos\varphi, \tag{14}$$

but now with the normalized frequency $$x_{TE} = \frac{2\pi p}{c}\sqrt{f^2 - f_{co}^2} \text{ or } f = \sqrt{\left(\frac{x_{TE}c}{2\pi p}\right)^2 + f_{co}^2}$$

and with the perturbation $$a_{TE} = \frac{Z_{TEM}\,p}{cL_{TE}}.$$

If four, that is, s=4, radial rods are used to prevent mode conversion TEM<->TE11, as in a preferred application, $L_{TEM}=L_{rod}/4$ and $L_{TE}\gamma L_{rod}/2$, since the TE11 wave only "sees" two rods arranged parallel to the E-field. However, the perturbation parameter becomes identical in both cases as a result:

$$a_{TEM} = a_{TE} = \frac{2Z_{TEM}\,p}{cL_{rod}},$$

which in turn means that the normalized cut-off frequencies ($x_u$, $x_o$) of the TEM and TE11 bands are the same.

As a result, the dispersions of TEM and TE11 modes in periodic structures with four connecting structures are very tightly interlinked. The only parameter that makes it possible to individually influence both modes is the cut-off frequency $f_{co}$ of the TE11 mode in the coaxial line, which upwardly shifts the TE11 bands.

The following tables summarize the (non-normalized) cut-off frequencies of the TEM and $TE_{11}$ bands of 4 rod geometries:

Small interference a<<3n

| Mode | Band | Lower frequency limit | Upper frequency limit |
|---|---|---|---|
| TEM | 1 | $\sqrt{\frac{6a}{3+a}}\,f_0$ | $\pi f_0$ |
| | n | $\left((n-1)\pi + \frac{2a/(n-1)/\pi}{1 + 2a/(n-1)^2/\pi^2}\right)f_0$ | $n\pi f_0$ |
| $TE_{11}$ | 1 | $\sqrt{\frac{6a}{3+a}f_0^2 + f_{co}^2}$ | $\sqrt{(\pi f_0)^2 + f_{co}^2}$ |
| | M | $\sqrt{\left((n-1)\pi + \frac{2a/(n-1)/\pi}{1 + 2a/(n-1)^2/\pi^2}\right)^2 f_0^2 + f_{co}^2}$ | $\sqrt{(n\pi f_0)^2 + f_{co}^2}$ |

Large interference a>>3n

| Mode | Band | Lower frequency limit | Upper frequency limit |
|---|---|---|---|
| TEM | N | $\left(n\pi - \frac{n\pi a}{n^2\pi^2 + 2a}\left(\sqrt{1 + \frac{8}{a} + \frac{4n^2\pi^2}{a^2}} - 1\right)\right)f_0$ | $n\pi f_0$ |
| $TE_{11}$ | M | $\sqrt{f_{TEM,u,n}^2 + f_{co}^2}$ | $\sqrt{(n\pi f_0)^2 + f_{co}^2}$ |

wherein $$f_0 = \frac{c}{2\pi p},\ f_{co} \cong \frac{c}{\pi}\frac{2}{D_a + D_i}$$

and the perturbation is $$a = \frac{2Z_{TEM}\,p}{cL_{Stab}}.$$

The following applies with respect to $Z_{TEM}$:

$$Z_{TEM} = \frac{1}{2\pi}\sqrt{\frac{\mu}{\varepsilon}}\ln\frac{D_a}{D_i}$$

Figure 4:
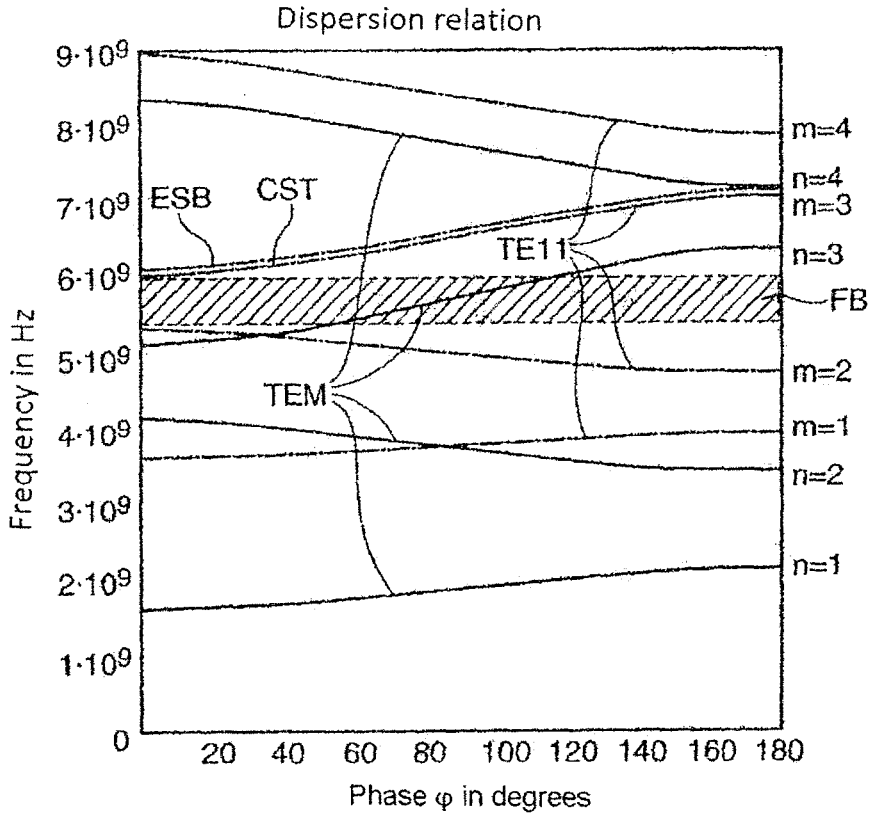
FIG. 4 is a diagram of all dispersion relations up to a specific maximum frequency providing a comparison of the equivalent circuit diagram with a full-wave EM simulation.

The dispersion relation depicted in FIG. 4 shows an excellent correlation between the equivalent circuit diagram description and a full-wave simulation for a coaxial conductor structure having a respective four connecting rods per elementary cell and the additional dimensions $D_a$=36 mm, $D_i$=22.8 mm, p=72 mm, $D_S$≈1.5 mm, with a pure rectangular rod measuring 1×2 mm; $L_{rod}$=1.68 nH was here extracted from a numerical model by means of CST (computer simulation technology). The solid curves correspond to the TEM dispersion bands n=1, 2, 3, 4, and the dashed curves show the $TE_{11}$ dispersion bands m=1, 2, 3, 4, wherein both a CST simulation and ESB calculations (ESB: equivalent circuit diagram) were performed for both curves. Especially the four smallest bands are modeled to nearly match the stroke width!

In the dispersion relation presented on FIG. 4, it makes sense to use the $3^{rd}$ TEM band (n=3) for transmission, more precisely the distinctly smaller frequency range FR of 5.4 to 5.9 GHz.

Since as large a mono-mode frequency range as possible is most often desired, the used TEM band should be as broad as possible, as should the TE11 band gap as well. However, since the TEM mode cannot be influenced independently of the TE11 mode, as was demonstrated above, the compromise will involve perturbation a in the transition area $\alpha \approx 3n$, making the band width and band gap about the same size. In such a conductor geometry, the perturbation at a=7.8 lies precisely in the transition area, where both approximation formulas become imprecise for the cut-off frequencies, as summarized in the above table. Despite this fact, the cut-off frequencies of the two lowest bands can preferably be calculated using the formula for the large perturbation. At the higher bands with n>2, the formulas for the small perturbation are more accurate. Of course, a numerical procedure, e.g., Newton's method, yields precise results.

REFERENCE LIST

CST Computer Simulation Technology
ESB Equivalent circuit diagram
E Input
A Output
L1, L2 Conductor inductance
L Shunt admittance
S Structure, connecting structure
AL External conductor
IL Internal conductor
$D_a$ External conductor inner diameter
$D_i$ Internal conductor (outer) diameter
$D_S$ Rod diameter
p Elementary cell length
BL Band gap
B Band

The invention claimed is:

1. A coaxial conductor structure for an interference-free transmission of a single propagable TEM mode of an HF signal wave within at least one band of N frequency bands forming within the framework of a dispersion relation, with N as a positive natural number, comprising:

a) an internal conductor having a circular cross section, with an internal conductor diameter $D_i$, b) an external conductor surround the internal conductor in a radially equidistant manner, with an external conductor inner diameter $D_a$;

c) an axially extending, common conductor section of internal and external conductor, along which, in equidistant intervals p and s rod-shaped structures with a rod diameter $D_S$ that electrically connect the internal conductor with the external conductor are provided, wherein, in order to allow the single TEM mode to propagate along the coaxial conductor structure unimpeded by higher excitation modes, which arise at least in a form of a $TE_{11}$ mode within M frequency bands, with M as a positive natural number, the parameters $D_i$, $D_a$, $D_S$, p, and s are selected so that i) a lower frequency limit $f_u$(TEM) of the single TEM mode propagating within an n≥2-nd band is equal to an upper offset-frequency $f_o(TE_{11})$ of the forming $TE_{11}$ mode in the m-th band ± of a tolerance range Δf where n is a positive natural number, n≤N, m is a positive natural number, m≤M; and ii) an upper cut-off frequency band $f_o$(TEM) of the single TEM mode propagating within the n≥2-nd band is equal to a lower cut-off frequency $f_u(TE_{11})$ of the $TE_{11}$ mode in the (m+1)-th band of the tolerance range Δf;

iii) wherein the tolerance range Δf measures ⅓ of the bandwidth of the n-th TEM mode wherein $$|\Delta f| < \frac{1}{3}(f_{o,TEM,n} - f_{u,TEM,n}).$$

2. The coaxial conductor structure according to claim 1, wherein s is equal to 3 or 4.

3. The coaxial conductor structure according to claim 1 wherein for i):

$$f_u(TEM) = f_o(TE_{11}) \pm |\Delta f| \text{ with}$$

$$f_u(TEM) = \left((n-1)\pi + \frac{2a/(n-1)/\pi}{1 + 2a/(n-1)^2/\pi^2}\right) f_0$$

as well as $$f_o(TE_{11}) = \sqrt{(m\pi f_0)^2 + f_{co}^2}$$

and that the following applies for ii):

$$f_o(TEM) = f_u(TE_{11}) \pm |\Delta f| \text{ with}$$

$$f_o(TEM) = n\pi f_0 = \frac{nc}{2p} \text{ and}$$

as well as $$f_u(TE_{11}) = \sqrt{\left(m\pi + \frac{2a/m/\pi}{1 + 2a/m^2/\pi^2}\right)^2 f_0^2 + f_{co}^2}$$

and with perturbation:

$$a = \frac{Zp}{2cL};$$

impedance:

$$Z = \frac{1}{2\pi}\sqrt{\frac{\mu}{\varepsilon}} \ln\frac{D_a}{D_i};$$

inductance:

$$L = \frac{1}{s}\frac{D_a - D_i}{2}\frac{\mu}{4\pi}\ln\frac{D_a}{D_s};$$

cut-off frequency:

$$f_0 = \frac{c}{2\pi p};$$

and cut-off frequency of the $TE_{11}$ mode $$f_{co} \cong \frac{c}{\pi}\frac{2}{D_a + D_i};$$

wherein c equals light speed, μ equals magnetic permeability, and ∈ equals dielectric conductance.

4. The coaxial conductor structure according to claim 2 wherein for i):

$$f_u(TEM) = f_o(TE_{11}) \pm |\Delta f| \text{ with}$$

$$f_u(TEM) = \left((n-1)\pi + \frac{2a/(n-1)/\pi}{1 + 2a/(n-1)^2/\pi^2}\right) f_0$$

as well as $$f_o(TE_{11}) = \sqrt{(m\pi f_0)^2 + f_{co}^2}$$

and that the following applies for ii):

$$f_o(TEM) = f_u(TE_{11}) \pm |\Delta f| \text{ with}$$

$$f_o(TEM) = n\pi f_0 = \frac{nc}{2p} \text{ and}$$

as well as $$f_u(TE_{11}) = \sqrt{\left(m\pi + \frac{2a/m/\pi}{1 + 2a/m^2/\pi^2}\right)^2 f_0^2 + f_{co}^2}$$

and with perturbation:

$$a = \frac{Zp}{2cL};$$

impedance:

$$Z = \frac{1}{2\pi}\sqrt{\frac{\mu}{\varepsilon}}\ln\frac{D_a}{D_i};$$

inductance:

$$L = \frac{1}{s}\frac{D_a - D_i}{2}\frac{\mu}{4\pi}\ln\frac{D_a}{D_s};$$

cut-off frequency:

$$f_0 = \frac{c}{2\pi p};$$

cut-off frequency of the $TE_{11}$ mode and $$f_{co} \cong \frac{c}{\pi}\frac{2}{D_a + D_i};$$

wherein c equals light speed, μ equals magnetic permeability, and ∈ equals dielectric conductance.

5. A coaxial conductor structure for an interference-free transmission of a single TEM mode of an HF signal wave within at least one band of N frequency bands forming within a dispersion relation, with N being a positive natural number, comprising:

a) an internal conductor exhibiting a circular cross section, with an internal conductor diameter $D_i$, b) an external conductor that surrounds the internal conductor in a radially equidistant manner, with an external conductor inner diameter $D_a$; and c) an axially extending, common conductor section of internal and external conductor, along which, in equidistant interval p and s rod-shaped structures with a rod diameter $D_S$ that electrically connect the internal conductor with the external conductor are provided, wherein, in order to allow the single TEM mode to propagate along the coaxial conductor structure unimpeded by higher excitation modes, which arise at least in the form of a $TE_{11}$ mode within M frequency bands, with M being a positive natural number with parameters $D_i$, $D_a$, $D_S$, p, s being selected so that an upper cut-off frequency $f_o$(TEM) of the single TEM mode propagating within the first n=1 band of N is less than or equal to the lower cut-off frequency $f_u(TE_{11})$ of forming of a $TE_{11}$ mode in the first band, with m=1 band of M, wherein the following applies:

$$f_o(TEM) = \frac{c}{2p} \text{ and } und\ f_u(TE_{11}) = \sqrt{\frac{6a}{3+a}f_0^2 + f_{co}^2} \cdot \text{so that the}$$

following applies:

$$\frac{c}{2p} \le \sqrt{\frac{6a}{3+a}f_0^2 + f_{co}^2}$$

with $$f_0 = \frac{c}{2\pi p},\ f_{co} \cong \frac{c}{\pi}\frac{2}{D_a + D_i} \text{ and}$$

$$a = \frac{sZ_{TEM}\,p}{2cL_{rod}} \text{ and } Z_{TEM} = \frac{1}{2\pi}\sqrt{\frac{\mu}{\varepsilon}}\ln\frac{D_a}{D_i} \text{ and}$$

$$L = \frac{L_{rod}}{s},\ L_{rod} \approx \frac{(D_a - D_i)}{2}\frac{\mu}{4\pi}\ln\frac{D_a}{D_s},$$

an inductance L as, wherein s is the number of radial rods.

6. The coaxial conductor structure according to claim 1, wherein the rod-shaped structures situated in respectively equidistant intervals p of the internal and external conductor are arranged relative to the circumferential direction in such a way that the rod-shaped structures are each congruently located one behind the other in an axial projection to the axially extending, common conductor section, or the rod-shaped structures are offset in an axial sequence at an identical angular misalignment $\Delta\alpha$ respectively oriented in the circumferential direction of the internal and external conductor.

7. The coaxial conductor structure according to claim 2, wherein the rod-shaped structures situated in respectively equidistant intervals p of the internal and external conductor are arranged relative to the circumferential direction in such a way that the rod-shaped structures are each congruently located one behind the other in an axial projection to the axially extending common conductor section, or the rod-shaped structures are offset in an axial sequence at an identical angular misalignment $\Delta\alpha$ respectively oriented in the circumferential direction of the internal and external conductor.

8. The coaxial conductor structure according to claim 3, wherein the rod-shaped structures situated in respectively equidistant intervals p of the internal and external conductor are arranged relative to the circumferential direction in such a way that the rod-shaped structures are each congruently located one behind the other in an axial projection to the axially extending common conductor section, or the rod-shaped structures are offset in an axial sequence at an identical angular misalignment $\Delta\alpha$ respectively oriented in the circumferential direction of the internal and external conductor.

9. The coaxial conductor structure according to claim 4, wherein the rod-shaped structures situated in respectively equidistant intervals p of the internal and external conductor are arranged relative to the circumferential direction in such a way that the rod-shaped structures are each congruently located one behind the other in an axial projection to the axially extending common conductor section, or the rod-shaped structures are offset in an axial sequence at an identical angular misalignment $\Delta\alpha$ respectively oriented in the circumferential direction of the internal and external conductor.

10. The coaxial conductor structure according to claim 5, wherein the rod-shaped structures situated in respectively equidistant intervals p of the internal and external conductor are arranged relative to the circumferential direction in such a way that the rod-shaped structures are each congruently located one behind the other in an axial projection to the axially extending common conductor section, or the rod-shaped structures are offset in an axial sequence at an identical angular misalignment $\Delta\alpha$ respectively oriented in the circumferential direction of the internal and external conductor.

11. The coaxial conductor structure according to claim 1, wherein s is equal to at least 1.

12. The coaxial conductor structure according to claim 3, wherein s is equal to at least 1.

13. The coaxial conductor structure according to claim 5, wherein s is equal to at least 1.

14. The coaxial conductor structure according to claim 6, wherein s is equal to at least 1.

15. The coaxial conductor structure according to claim 7, wherein s is equal to at least 1.

16. The coaxial conductor structure according to claim 8, wherein s is equal to at least 1.

17. The coaxial conductor structure according to claim 9, wherein s is equal to at least 1.

18. The coaxial conductor structure according to claim 10, wherein s is equal to at least 1.

19. The coaxial conductor structure according to claim 6 wherein 90° is equal to $\Delta\alpha$.

20. The coaxial conductor structure according to claim 11 wherein 90° is equal to $\Delta\alpha$.

21. The coaxial conductor structure according to claim 1, wherein the rod-shaped structures comprise metallic internal and/or external conductors.

22. The coaxial conductor structure according to claim 2, wherein the rod-shaped structures comprise metallic internal and/or external conductors.

23. The coaxial conductor structure according to claim 3, wherein the rod-shaped structures comprise metallic internal and/or external conductors.

24. The coaxial conductor structure according to claim 4, wherein the rod-shaped structures comprise metallic internal and/or external conductors.

25. The coaxial conductor structure according to claim 5, wherein the rod-shaped structures comprise metallic internal and/or external conductors.

26. The coaxial conductor structure according to claim 6, wherein the rod-shaped structures comprise metallic internal and/or external conductors.

27. The coaxial conductor structure according to claim 19, wherein the rod-shaped structures comprise metallic internal and/or external conductors.

28. The coaxial conductor structure according to claim 1 wherein at least one of the internal conductor and external conductor cross section of the coaxial line is not of circular shape but exhibits a wave resistance of a round coaxial line.

29. The coaxial conductor structure according to claim 5 wherein at least one of the internal conductor and external conductor cross section of the coaxial line is not of circular shape but exhibits a wave resistance of a round coaxial line.

30. The coaxial conductor structure according to claim 11, wherein the rod-shaped structures comprise metallic internal and/or external conductors.

* * * * *